US006769674B2

(12) United States Patent
Chang

(10) Patent No.: US 6,769,674 B2
(45) Date of Patent: Aug. 3, 2004

(54) FOLDABLE WORKBENCH

(76) Inventor: Huei-Yu Chang, 12Fl., No. 17-1, Alley 97, Lane 110, Huchian St., Shijr City, Taipei Hsien (TW)

( * ) Notice: Subject to any disclaimer, the term of this patent is extended or adjusted under 35 U.S.C. 154(b) by 70 days.

(21) Appl. No.: 10/144,713

(22) Filed: May 15, 2002

(65) Prior Publication Data

US 2003/0214088 A1 Nov. 20, 2003

(51) Int. Cl.[7] ..... B25B 1/02

(52) U.S. Cl. ..... 269/139; 269/145; 269/200; 269/901

(58) Field of Search ..... 269/139, 145, 269/220, 901, 141, 138, 219, 91, 93, 94

(56) References Cited

U.S. PATENT DOCUMENTS

D256,533 S * 8/1980 Alessio ..... D6/400
4,278,243 A * 7/1981 Alessio ..... 269/16
4,909,491 A * 3/1990 Cheng ..... 269/16
6,113,088 A * 9/2000 Gakhar et al. ..... 269/139
D448,948 S * 10/2001 Wolff ..... D6/400

* cited by examiner

*Primary Examiner*—Joseph J. Hail, III
*Assistant Examiner*—Daniel Shanley
(74) *Attorney, Agent, or Firm*—Rosenberg, Klein & Lee

(57) ABSTRACT

A foldable workbench comprises at least a foldable leg frame, two clamp assemblies, to angular control board, several angular regulators, several clamp boards and a flat workbench, in which two clamp assemblies are linked to the foldable leg frame. The adjusting holes of the angular control board are connected to one side of clamp assemblies. Several angular regulators are arranged at both ends of the clamp assemblies. In addition, several clamp boards are bolted on the angular regulators. The flat workbench is placed on the angle iron rake of the brace.

17 Claims, 9 Drawing Sheets

FOLDABLE WORKBENCH

BACKGROUND OF THE INVENTION

1. Field of the Invention

This invention relates to a foldable workbench, in particular, with a combined joint constructed by an angular control board and a pivot blade.

2. Description of the Prior Art

The prior art of the foldable workbench as shown in ROC Patent 396920 mainly comprises a base plate, a guide channel steel, a cutting bench and some tool kits. The base plate provides two rails along the sides. The guide channel steel with a deep channel straddles over the rails on the base plate. The cutting bench has several grooves on the surface and two inverted U grooves on the bottom. The inverted U groove is installed with a plurality of ball bearings and a lock bolt. The tool kits includes a guide strap, a guide board and a push board. The ball bearing carries and moves the cutting bench along the rails on the base plate, and the lock bolt fixes the cutting bench on the rail. The tool kit is changeable dependent on the size and character of the work piece. The obvious weaknesses are: the patent workbench is assembled of a plurality of grooved board. It occupies too much space while not in use, and it is time consuming to disassemble while not to use and assemble again while to use it. The tool kit depends on what the size or character of the work piece object is, in other word, there must make a great number of tool kits available for any size and any character of the work piece. More important, the patented workbench is suitable for flat process, not applicable to angular process.

It is visible that the patented workbench has much room for improvement.

The inventor have appreciated such weaknesses the patented workbench and have worked hard for years in studying how to improve it and come up this foldable workbench.

SUMMARY OF THE INVENTION

The main object of the invention is to provide a foldable workbench easy for storage.

Another object of the invention is to provide a foldable workbench requiring least space for storage.

Another object of the invention is to provide a foldable workbench in which the angular control board controls the change of work angles of the workbench.

Another object of the invention is to provide a foldable workbench in which the pivot plate adjusts the clamp face of the clamp plate, and the components required are reduced to the minimum.

The foldable workbench of the invention at least comprises:

A foldable leg frame, constituting two parallel foldable braces, one of the brace side is attached with an angle iron rack. The braces are connected with joint bolts.

Two clamp assembles arranged in parallel. Each clamp assembly has a worm gear passing through its interior. The worm gear has a crank handle at one end.

Two angular control boards. Each board has a guide slot communicated with a plurality of adjusting holes and round hole at one end.

Several angle regulators including a yoke, a slide, a spring retainer and a lock plate. The yoke has a slot. A lock bolt fastens one end of the lock plate and the yoke together and another lock bolt passes the other end of the lock plate, the slide, and the spring retainer and enters the slot of the yoke. Finally the slide lies on the rail.

Several clamp boards with a plurality of holes punched.

A piece of flat work board with a plurality of holes punched. The work board has two racks disposed on both sides.

Two clamp assemblies are bolted on the braces respectively, several angle regulators are attached to the ends of the clamp devices and several clamp boards are bolted to the clamp assemblies respectively. A bolt will enter the round hole on the angular control board and one end of the clamp assembly and lock to the angle iron of the brace. In general condition, the flat work board is place on the angle iron rack attached to the leg.

DETAILED DESCRIPTION OF THE PREFERRED EMBODIMENT

Figure 1:
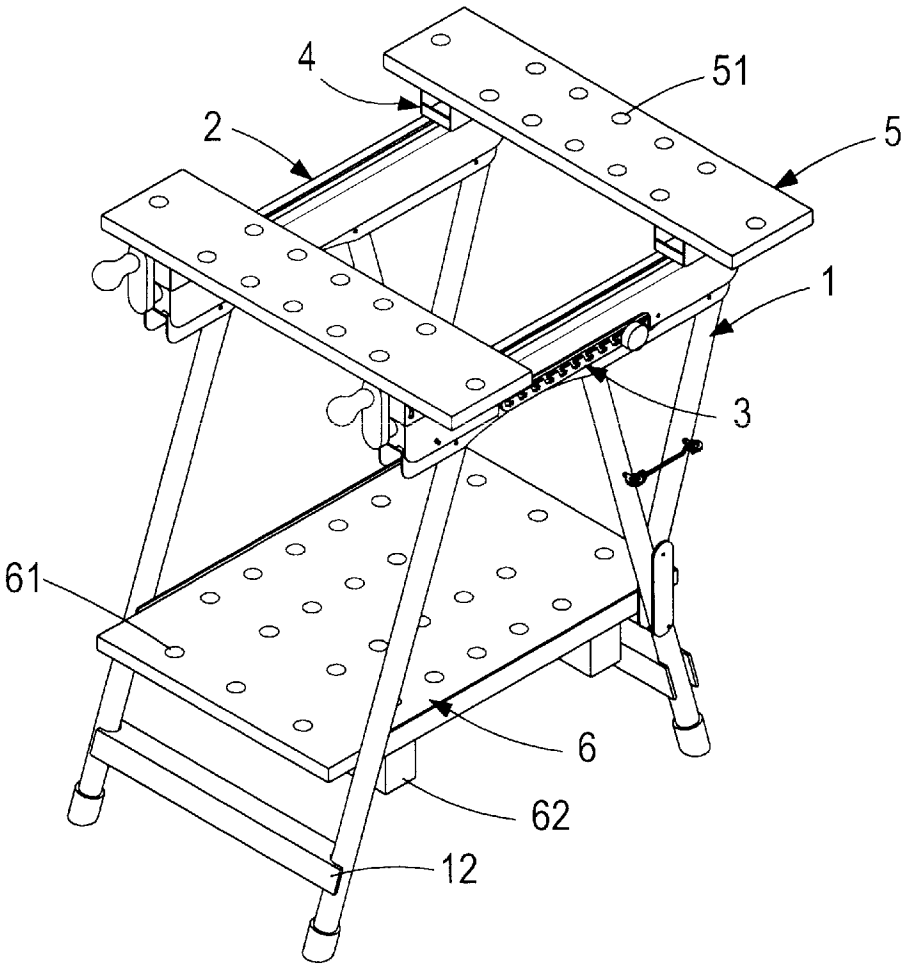
FIG. 1 is a stereo outlook of workbench of this invention.
Figure 2:
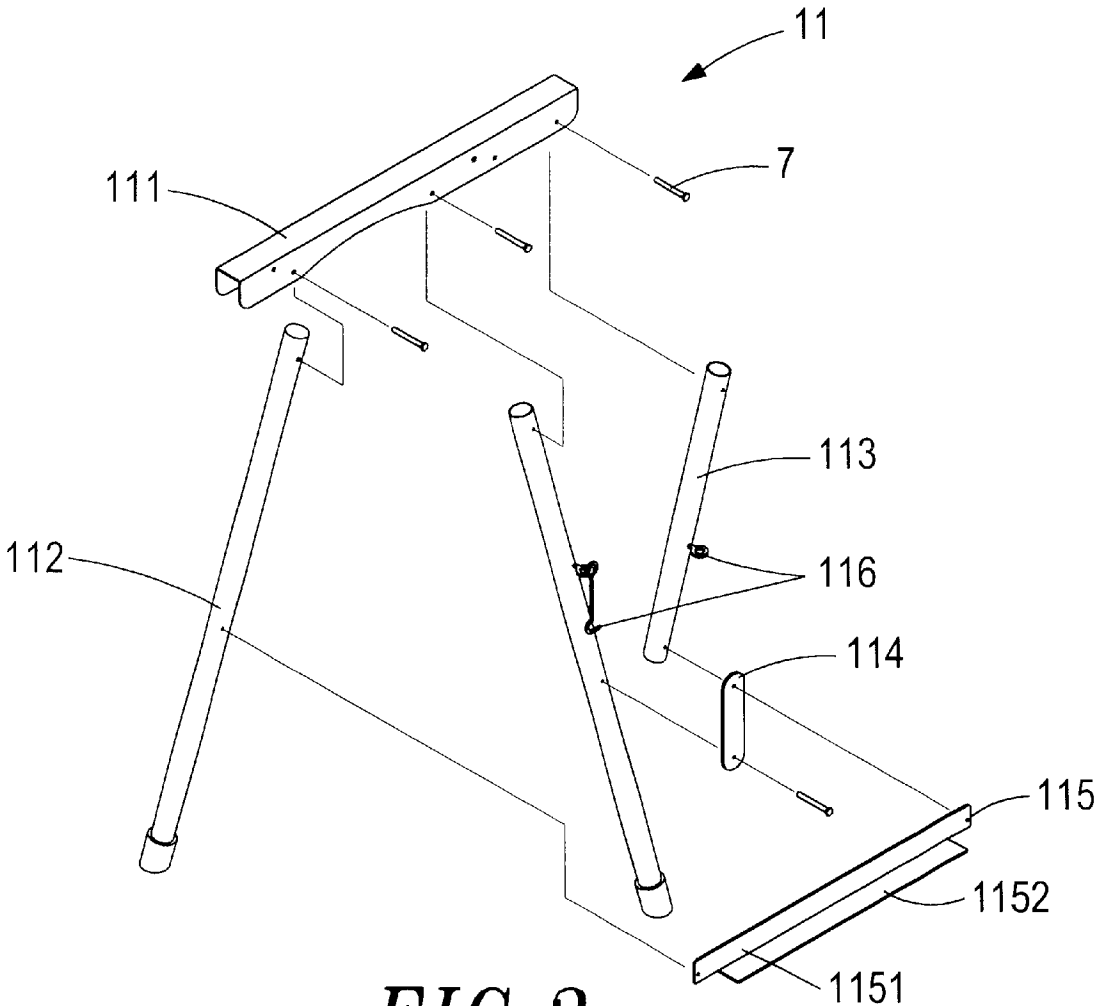
FIG. 2 shows a disassembly of foldable leg frame of the workbench of the invention.
Figure 3:
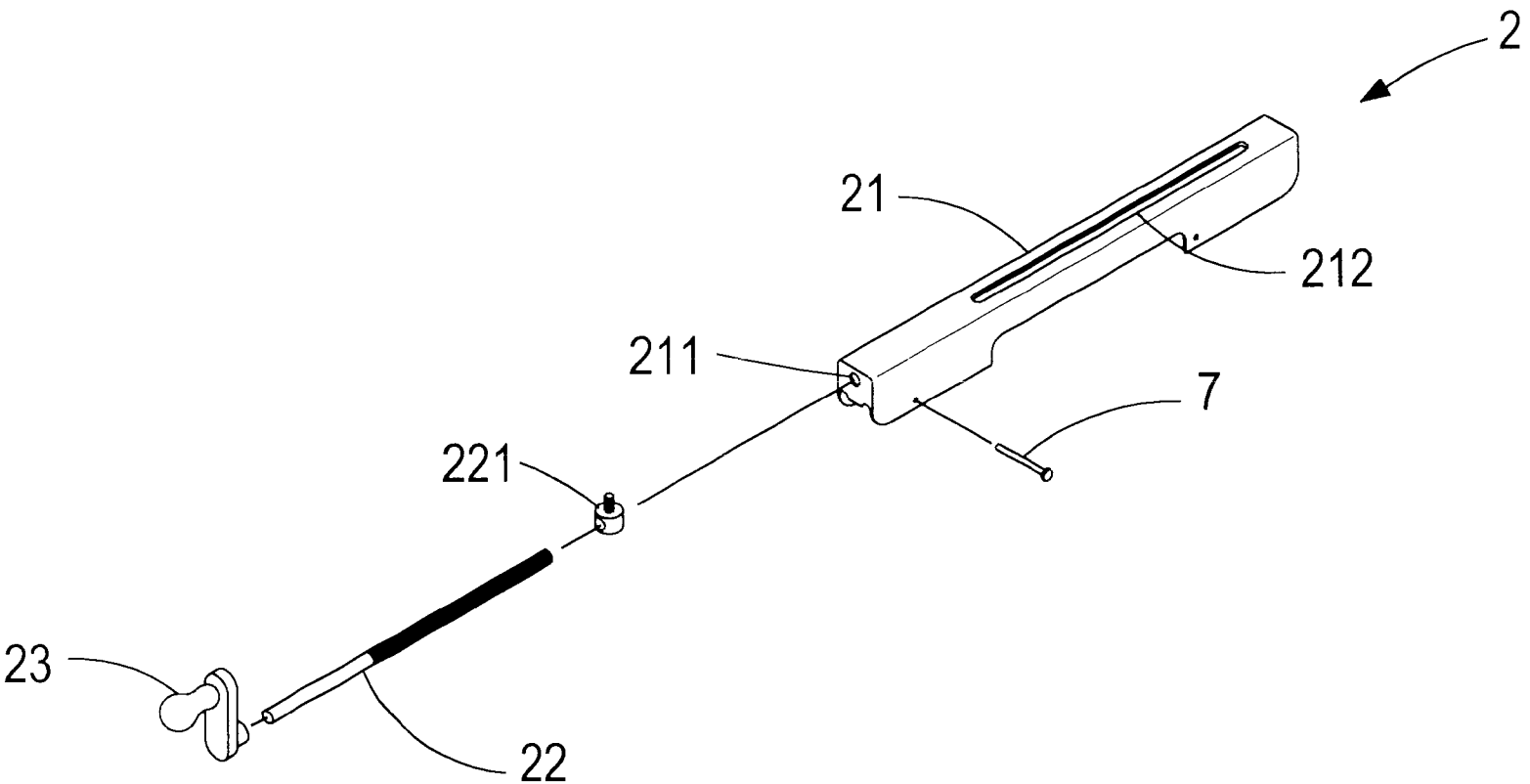
FIG. 3 shows a disassembly of clamp assembly of the workbench of the invention.
Figure 4:
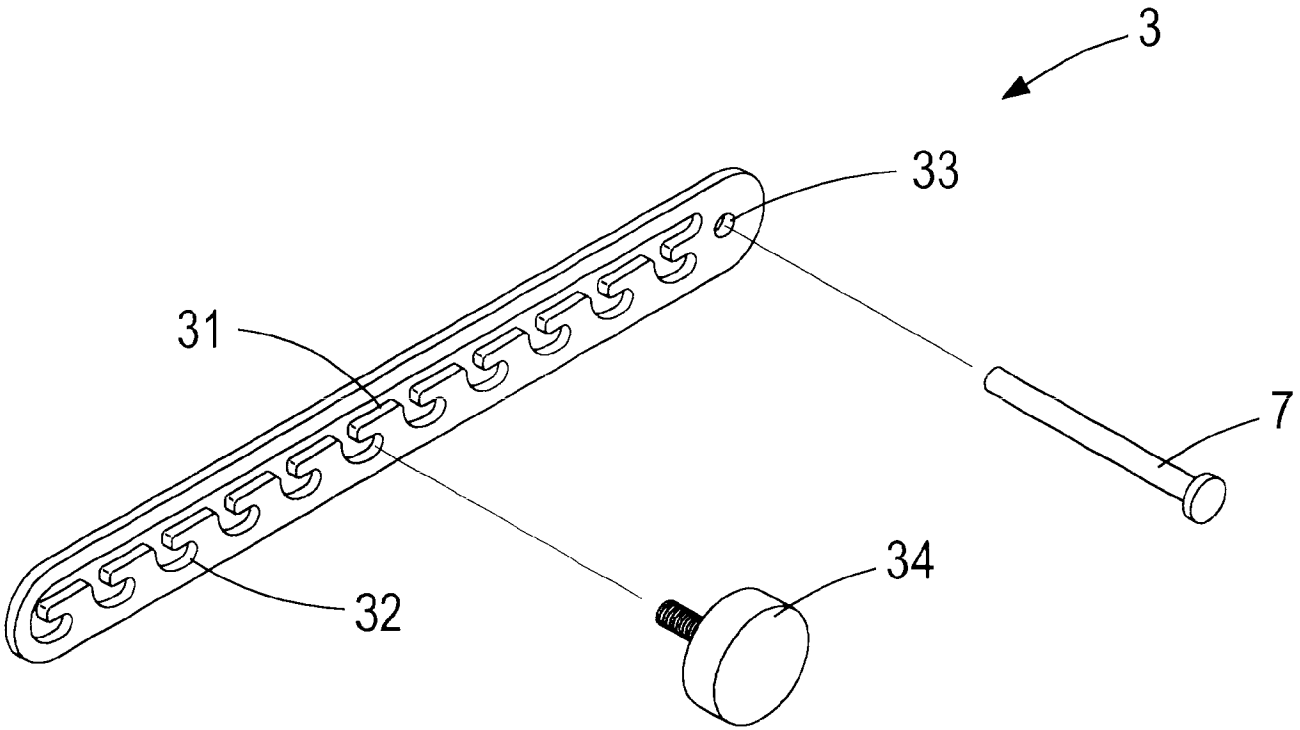
FIG. 4 is an amplified disassembly of the angular control board of workbench.
Figure 5:
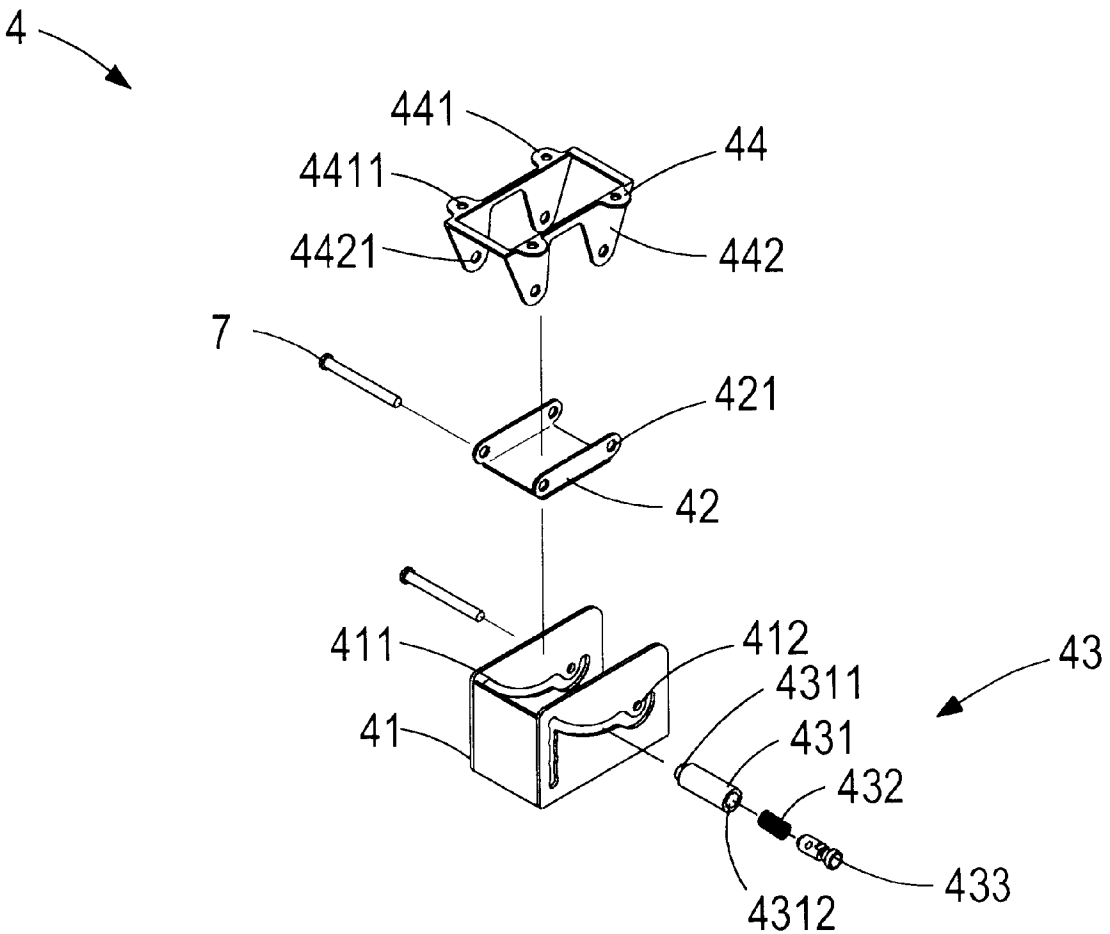
FIG. 5 is a stereo disassembly of the angular regulator of the workbench.

As shown in FIGS. 1, 2, 3, 4 and 5, the foldable workbench of the invention mainly comprises the following.

A foldable leg frame 1 constitutes two parallel foldable braces 11, each brace 11 is made of a channel tube 111 with one end connected to a center leg 112 and other end to a short leg 113 both by a lock bolt 7. The center hole of the channel tube 111 is connected to a center leg 112. One piece of the pivot plate 114 is provided with one end to link with a short leg 113, an angle iron rack 115 and a center leg 112. An angle iron rack 115 is mounted on the side of the foldable brace 11. A hook 116 is employed to bind the center leg 112 and the short leg 113 together. The angle iron rack 115 has a long wall 1151 and short side 1152. The lower part of the center leg 112 of one brace 11 is linked with the lower part of the center leg 112 of the counter part brace 11 by a connector 12.

Two pieces of clamp assembly 2 are in parallel arrangement and composed of a section of channel tube 21 with an opening 211 at one end to receive worm gear 22 and a crank handle 23. The channel tube 21 has a guide slot 212 on the top.

Two angular control boards 3, each board has a long guide groove 31, a plurality of adjustment holes 32 drilled along the guide groove 31 and a round hole 33 at the end.

Several angular regulators 4, each comprises a yoke 41, a slide 42, a spring retainer 43 and a lock plate 44. The yoke 41 has a guide slot 411 and a guide slot 412. The slide 42 is a piece of channel tube with lock holes 421 on both ends. The spring retainer 43 consists of a cylinder 431 with a lug 4311 on one end and a cavity 4312 to receive a press unit 433 and a spring 432. The lock plate 44 has four transverse lugs 441 and lock holes 4411 and four downward lugs 442 and lock holes 4421. One lock bolt 7 will enter and lock together the lock hole 4421 on the lock plate 44, the lock hole 421 on the slide 42 and the guide slot 412 on the yoke 41. Another lock bolt 7 will link the lock hole 4421, the lock hole 421 on the slide 42, and the guide slot 412 on the yoke 41 and keep the cylinder 431, press unit 433 and spring 432 within the inside of the two yoke 41 walls.

Several clamp boards 5 with a plurality of holes 51 punched for receiving a support 52.

A flat work board 6 with a plurality of holes 61 punched. The work board 6 has racks 62 extended from both sides of the work board 6, and the distance between these two racks 62 equals to the short side 1152 of the angle iron rack 115.

Two clamp assemblies 2 are bolted to the channel tubes 111 on the fordable leg frame 1. Several angular regulators 4 are attached to ends of the clamp assemblies 2. The angular regulator 4 adjacent to the crank handle 23 of the clamp assembly 2 is bolted to the clamp assembly 2. Another angular regulator 4 is fastened on the lock bolt 221. The lock bolt 221 further enters the guide slot 212 and fixes the worm gear 22. The angle control boards 3 are disposed on the sides of the clamp assemblies 2 and are locked by a lock bolt 34 through the round holes 33 to the channel tube 111 of the foldable brace 11. Several clamp boards 5 are bolted to the lug holes 4411 on the lock plate 44. The flat work board 6 lies on the angle iron rack 115.

Figure 6:
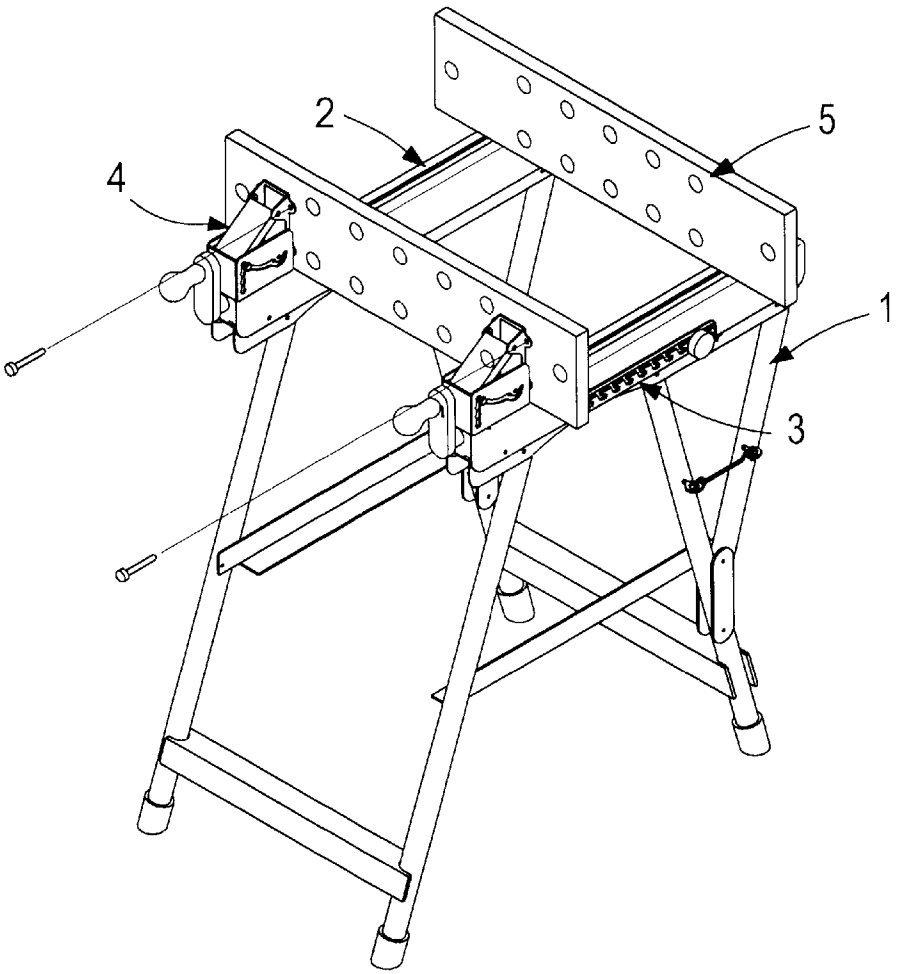
FIG. 6 is an outlook of the first embodiment of the workbench of the invention.
Figure 7:
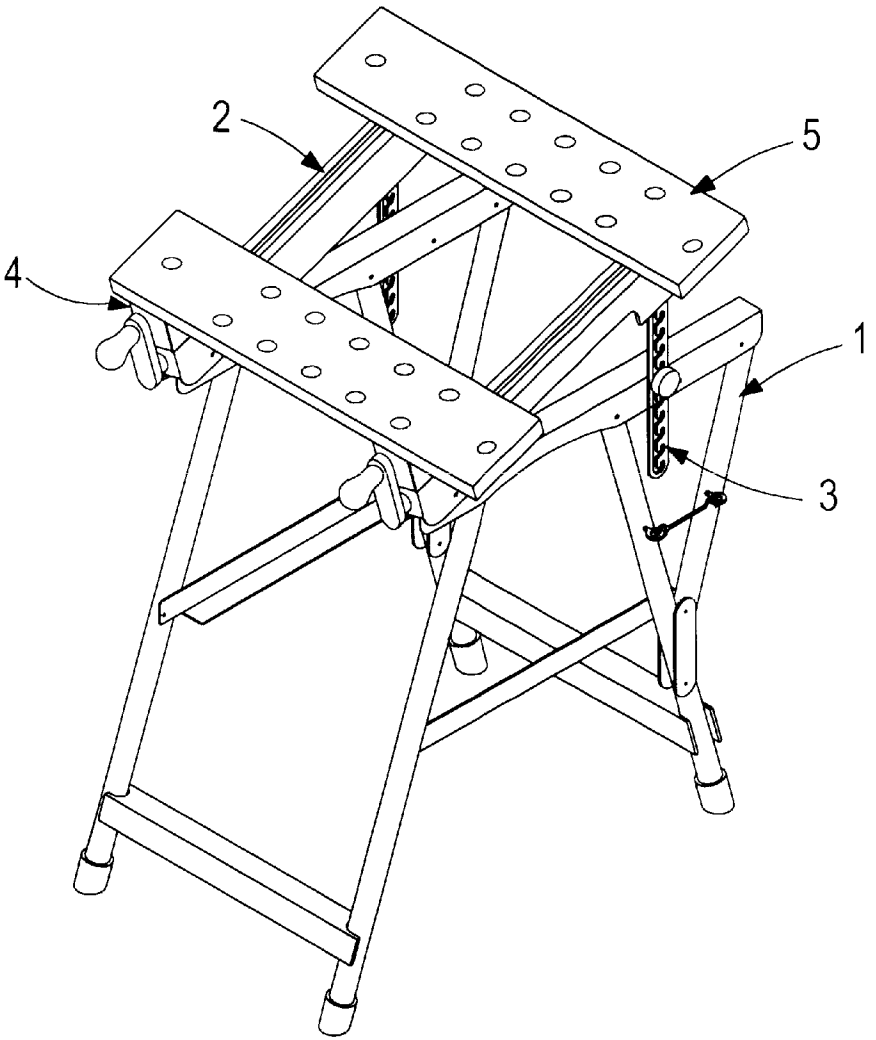
FIG. 7 is an outlook of the second embodiment of the workbench of the invention.
Figure 8:
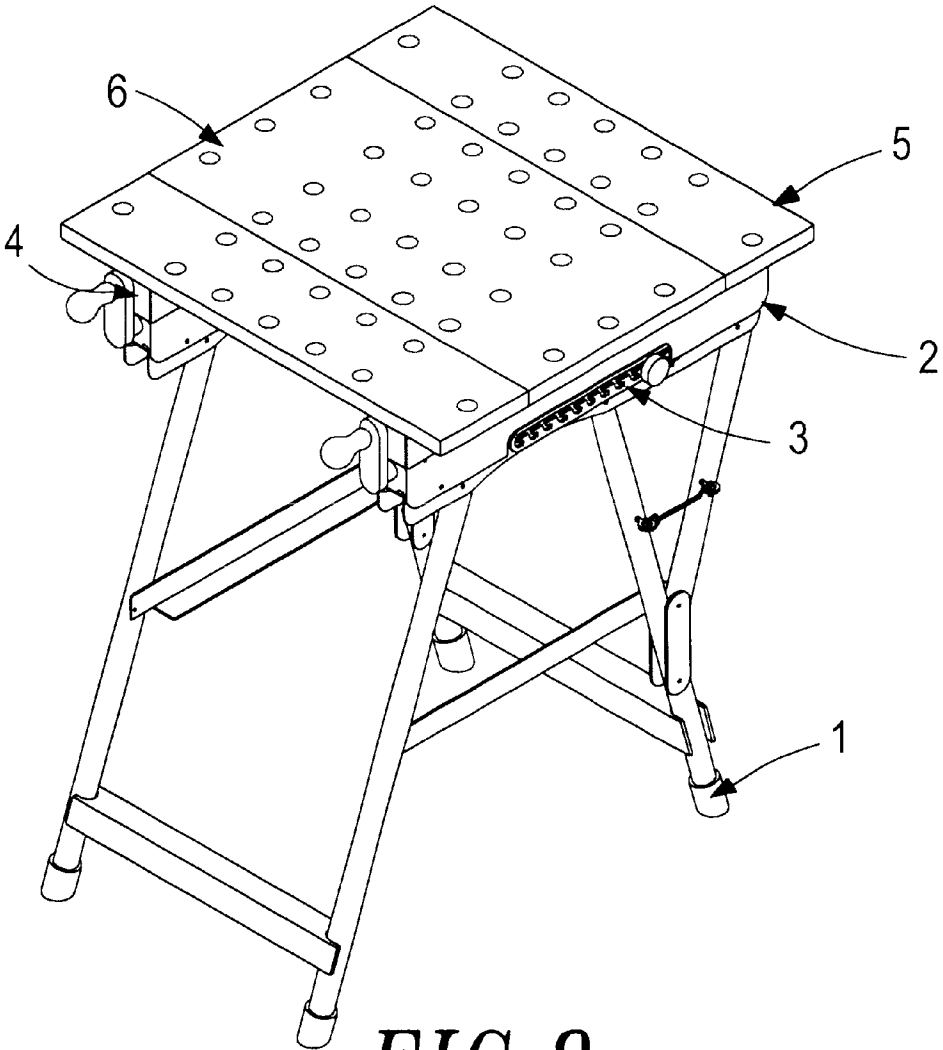
FIG. 8 is an outlook of the third embodiment of the workbench of the invention.
Figure 9:
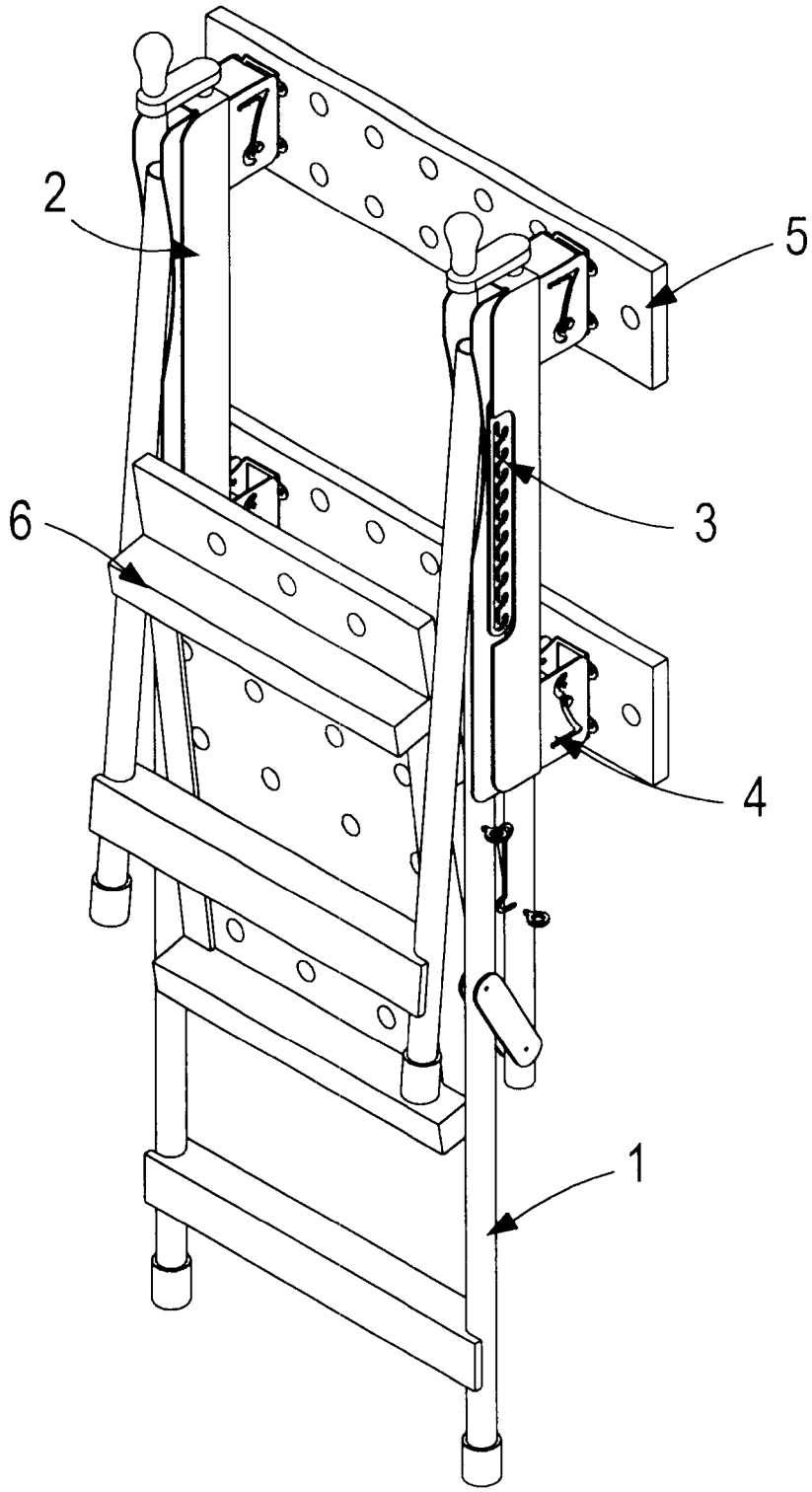
FIG. 9 shows a workbench in folded arrangement.

As shown in FIGS. 6, 7, 8 and 9, the work piece is placed between two clamp board 5, by turning the crank handle 23 which drives the worm gear 22 and the angular regulator 4 to secure the proper working position. In case it requires a wider working area on the workbench, take up the flat work board 6 from the angle iron rack 115 and place it on the channel tube 21 of the clamp assembly 2, then turn the crank handle 23 to gain proper hold of the flat work board 6. In addition, it allows the lock bolt 34 to be moved along the adjustment holes 32 along the guide groove 31 on the angular control board 3, the clamp assembly 2 will form another angle as the foldable leg frame 1 changes position along the pivot of the lock bolt 7. When the spring 432 of the spring retainer 43 is pressed to disengage the inner wall of the yoke 41, the spring retainer 43 is permitted to move along the guide slot 411, so the angular regulator 4 will make angle change in the clamp board 5. While not in use, the channel tube 111 of the foldable leg frame 1 is allowed to fold up along the pivot of the lock bolt 7.

Comparing with the prior art of the foldable workbench, the foldable workbench discovered in the invention dominates the following merits:

1. The foldable workbench is easy to fold for storage.
2. The foldable workbench after folded occupies the least space.
3. The angular control board provides an easy adjustment of working angle for the workbench to suit the work piece.
4. The angular regulator is employed to minimize the parts requirements.

Many changes and modifications in the above described embodiment of the invention can, of course, be carried without departing from the scope thereof. Accordingly, to promote the progress in science and the useful arts, the invention is disclosed and is intended to be limited only by the scope of the appended claims.

What is claimed is:

1. A foldable workbench, comprising:

a foldable leg frame constituting two foldable braces, each brace having a channel tube with one end connected to a center leg and another end to a short leg, a center hole of said channel tube connected to a center leg, an angle iron rack mounted on a side of said brace, a lower part of said center leg of one brace linked with a lower part of said center leg of a counter part brace by a connector;

two pieces of clamp assembly in parallel arrangement and including a section of said channel tube with an opening at one end to receive a worm gear and a crank handle, said channel tube having a guide slot on top;

two angular control boards, each board having a guide groove, a plurality of adjustment holes drilled along the guide groove and a round hole at an end of said angular control board;

a plurality of angular regulators, each comprising a yoke, a slide, a spring retainer and a lock plate;

a plurality of clamp boards with a plurality of holes punched;

a flat work board with a plurality of holes punched, having racks extended from both sides at a proper place;

two clamp assemblies bolted to said channel tube on said foldable leg frame, said angular regulators attached to said clamp assemblies, one of said angular regulators adjacent to said crank handle of each said clamp assembly bolted to said clamp assembly, another angular regulator fastened on a lock bolt, said lock bolt further entering a guide slot of said clamp assembly and fixing said worm gear, said clamp boards bolted on said angular regulators to be angularly adjustable relative to said clamp assemblies, and said flat work board lying on said angle iron rack of said foldable brace.

2. The foldable workbench of claim 1, wherein a pivot plate links with a lower part of said center leg and a lower part of said short leg, a hook unites said center leg and said short leg together.

3. The foldable workbench of claims 1 or 2, wherein said angle iron rack has a vertical wall with one end linked to said short leg and another end to said center leg.

4. The foldable workbench of claim 1, wherein said angle iron rack is employed to receive said flat work board.

5. The foldable workbench of claim 1, wherein said round hole on said angle control board is used to link to one side of said clamp assembly.

6. The foldable workbench of claim 1, wherein said angle control board is locked by a lock bolt to said channel tube of said foldable brace.

7. The foldable workbench of claim 1, wherein said clamp boards and said flat work board have a plurality of holes for support.

8. The foldable workbench of claim 1, wherein said angular regulator has a yoke with a guide slot and a round hole.

9. The foldable workbench of claim 1, wherein a slide of said angular regulator is a channel tube with lock holes on both ends.

10. The foldable workbench of claims 1, wherein a lock plate of said angular regulator has transverse lugs with holes and downward lugs with holes for connection.

11. The foldable workbench of claims 8, 9, or 10, wherein a lock hole at one end of said lock plate is pivoted with a guide slot of said yoke, a lock hole at another end of said lock plate is pivoted with a lock hole of said slide, another end of said slide is mounted on a lock hole with a spring retainer, said spring retainer is fixed on said yoke through a guide at a side of said yoke with a press unit and a spring, said press unit is fixed inside a cavity of a cylinder with one end of said spring, said cylinder is fixed at another side of said slide with a lug, whereby said spring pushes said press unit and cylinder aside and supports inner walls of said yoke.

12. The foldable workbench of claim 1, wherein said clamp board is fastened on lock holes of said lock plate by bolts.

13. A foldable workbench comprising:

a foldable leg frame constituting two foldable braces, each brace having a channel tube with one end connected to a center leg and another end to a short leg with a bolt, a center hole of said channel tube connected to a center leg, an angle iron rack mounted on a side of said brace, a lower part of said center leg of one brace linked with a lower part of said center leg of a counter part brace by a connector;

two pieces of clamp assembly in parallel arrangement and including a section of said channel tube with an opening at one end to receive a worm gear and a crank handle, said channel tube having a guide slot on top;

two angular control boards, each board having a guide groove, a plurality of adjustment holes drilled along the guide groove and a round hole at an end of said angular control board;

a plurality of angular regulators, each comprising a yoke, a slide, a spring retainer and a lock plate;

a plurality of clamp boards with a plurality of holes punched;

a flat work board with a plurality of holes punched, having racks extended from both sides at a proper place;

two clamp assemblies bolted to said channel tube on said foldable leg frame, said angular regulators attached to said clamp assemblies, one of said angular regulators adjacent to said crank handle of each said clamp assembly bolted to said clamp assembly, another angular regulator fastened on a lock bolt, said lock bolt further entering a guide slot of said clamp assembly and fixing said worm gear, said clamp boards bolted on at least one said angular regulator, and said flat work board lying on said angle iron rack of said foldable brace;

wherein a spring retainer consists of a cylinder with a lug on one end and a cavity to receive a press unit and a spring.

14. The foldable workbench of claim 13, wherein a lock hole at one end of said lock plate is pivoted with a guide slot of said yoke, a lock hole at another end of said lock plate is pivoted with a lock hole of said slide, another end of said slide is mounted on a lock hole with a spring retainer, said spring retainer is fixed on said yoke through a guide at a side of said yoke with a press unit and a spring, said press unit is fixed inside a cavity of a cylinder with one end of said spring, said cylinder is fixed at another side of said slide with a lug, whereby said spring pushes said press unit and cylinder aside and supports inner walls of said yoke.

15. A foldable workbench comprising:

a foldable leg frame constituting two foldable braces, each brace having a channel tube with one end connected to a center leg and another end to a short leg with a bolt, a center hole of said channel tube connected to a center leg, an angle iron rack mounted on a side of said brace, a lower part of said center leg of one brace linked with a lower part of said center leg of a counter part brace by a connector;

two pieces of clamp assembly in parallel arrangement and including a section of said channel tube with an opening at one end to receive a worm gear and a crank handle, said channel tube having a guide slot on top;

two angular control boards, each board having a guide groove, a plurality of adjustment holes drilled along the guide groove and a round hole at an end of said angular control board;

a plurality of angular regulators, each comprising a yoke, a slide, a spring retainer and a lock plate;

a plurality of clamp boards with a plurality of holes punched;

a flat work board with a plurality of holes punched, having racks extended from both sides at a proper place;

two clamp assemblies bolted to said channel tube on said foldable leg frame, said angular regulators attached to said clamp assemblies, one of said angular regulators adjacent to said crank handle of each said clamp assembly bolted to said clamp assembly, another angular regulator fastened on a lock bolt, said lock bolt further entering a guide slot of said clamp assembly and fixing said worm gear, said clamp boards bolted on at least one said angular regulator, and said flat work board lying on said angle iron rack of said foldable brace;

wherein said angular regulator has a yoke with a guide slot and a round hole;

wherein a lock hole at one end of said lock plate is pivoted with a guide slot of said yoke, a lock hole at another end of said lock plate is pivoted with a lock hole of said slide, another end of said slide is mounted on a lock hole with a spring retainer, said spring retainer is fixed on said yoke through a guide at a side of said yoke with a press unit and a spring, said press unit is fixed inside a cavity of a cylinder with one end of said spring, said cylinder is fixed at another side of said slide with a lug, whereby said spring pushes said press unit and cylinder aside and supports inner walls of said yoke.

16. A foldable workbench comprising:

a foldable leg frame constituting two foldable braces, each brace having a channel tube with one end connected to a center leg and another end to a short leg with a bolt, a center hole of said channel tube connected to a center leg, an angle iron rack mounted on a side of said brace, a lower part of said center leg of one brace linked with a lower part of said center leg of a counter part brace by a connector;

two pieces of clamp assembly in parallel arrangement and including a section of said channel tube with an opening at one end to receive a worm gear and a crank handle, said channel tube having a guide slot on top;

two angular control boards, each board having a guide groove, a plurality of adjustment holes drilled along the guide groove and a round hole at an end of said angular control board;

a plurality of angular regulators, each comprising a yoke, a slide, a spring retainer and a lock plate;

a plurality of clamp boards with a plurality of holes punched;

a flat work board with a plurality of holes punched, having racks extended from both sides at a proper place;

two clamp assemblies bolted to said channel tube on said foldable leg frame, said angular regulators attached to said clamp assemblies, one of said angular regulators adjacent to said crank handle of each said clamp assembly bolted to said clamp assembly, another angular regulator fastened on a lock bolt, said lock bolt further entering a guide slot of said clamp assembly and fixing said worm gear, said clamp boards bolted on at least one said angular regulator, and said flat work board lying on said angle iron rack of said foldable brace;

wherein a slide of said angular regulator is a channel tube with lock holes on both ends;

wherein a lock hole at one end of said lock plate is pivoted with a guide slot of said yoke, a lock hole at another end of said lock plate is pivoted with a lock hole of said slide, another end of said slide is mounted on a lock hole with a spring retainer, said spring retainer is fixed on said yoke through a guide at a side of said yoke with a press unit and a spring, said press unit is fixed inside a cavity of a cylinder with one end of said spring, said cylinder is fixed at another side of said slide with a lug, whereby said spring pushes said press unit and cylinder aside and supports inner walls of said yoke.

17. A foldable workbench comprising:

a foldable leg frame constituting two foldable braces, each brace having a channel tube with one end connected to a center leg and another end to a short leg with a bolt, a center hole of said channel tube connected to a center leg, an angle iron rack mounted on a side of said brace, a lower part of said center leg of one brace linked with a lower part of said center leg of a counter part brace by a connector;

two pieces of clamp assembly in parallel arrangement and including a section of said channel tube with an opening at one end to receive a worm gear and a crank handle, said channel tube having a guide slot on top;

two angular control boards, each board having a guide groove, a plurality of adjustment holes drilled along the guide groove and a round hole at an end of said angular control board;

a plurality of angular regulators, each comprising a yoke, a slide, a spring retainer and a lock plate;

a plurality of clamp boards with a plurality of holes punched;

a flat work board with a plurality of holes punched, having racks extended from both sides at a proper place;

two clamp assemblies bolted to said channel tube on said foldable leg frame, said angular regulators attached to said clamp assemblies, one of said angular regulators adjacent to said crank handle of each said clamp assembly bolted to said clamp assembly, another angular regulator fastened on a lock bolt, said lock bolt further entering a guide slot of said clamp assembly and fixing said worm gear, said clamp boards bolted on at least one said angular regulator, and said flat work board lying on said angle iron rack of said foldable brace;

wherein a lock plate of said angular regulator has transverse lugs with holes and downward lugs with holes for connection;

wherein a lock hole at one end of said lock plate is pivoted with a guide slot of said yoke, a lock hole at another end of said lock plate is pivoted with a lock hole of said slide, another end of said slide is mounted on a lock hole with a spring retainer, said spring retainer is fixed on said yoke through a guide at a side of said yoke with a press unit and a spring, said press unit is fixed inside a cavity of a cylinder with one end of said spring, said cylinder is fixed at another side of said slide with a lug, whereby said spring pushes said press unit and cylinder aside and supports inner walls of said yoke.

* * * * *